US007452056B2

(12) United States Patent
Mizutani et al.

(10) Patent No.: US 7,452,056 B2
(45) Date of Patent: Nov. 18, 2008

(54) LIQUID EJECTION HEAD AND IMAGE-FORMING APPARATUS USING THE SAME

(75) Inventors: Michinari Mizutani, Kanagawa (JP); Shuichi Murakami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 293 days.

(21) Appl. No.: 11/092,801

(22) Filed: Mar. 30, 2005

(65) Prior Publication Data

US 2005/0168531 A1 Aug. 4, 2005

Related U.S. Application Data

(63) Continuation of application No. 10/231,300, filed on Aug. 30, 2002, now abandoned.

(30) Foreign Application Priority Data

Aug. 31, 2001 (JP) ..... 2001-264733

(51) Int. Cl.
*B41J 2/21* (2006.01)

(52) U.S. Cl. ..... 347/43

(58) Field of Classification Search ..... 347/43
See application file for complete search history.

(56) References Cited

U.S. PATENT DOCUMENTS

| | | | |
|---|---|---|---|
| 4,313,124 | A | 1/1982 | Hara |
| 4,345,262 | A | 8/1982 | Shirato et al. |
| 4,459,600 | A | 7/1984 | Sato et al. |
| 4,463,359 | A | 7/1984 | Ayata et al. |
| 4,558,333 | A | 12/1985 | Sugitani et al. |
| 4,608,577 | A | 8/1986 | Hori |
| 4,723,129 | A | 2/1988 | Endo et al. |
| 4,740,796 | A | 4/1988 | Endo et al. |
| 5,218,376 | A | 6/1993 | Asai |
| 6,155,673 | A | 12/2000 | Nakajima et al. |
| 6,280,020 | B1 | 8/2001 | Tachihara et al. |
| 6,350,016 | B1 | 2/2002 | Tachihara et al. |
| 6,520,626 | B1 | 2/2003 | Murakami |
| 6,540,335 | B2 | 4/2003 | Touge et al. |
| 6,547,354 | B1 * | 4/2003 | Askeland et al. ..... 347/12 |
| 6,729,714 | B2 | 5/2004 | Sturgeon et al. |
| 6,773,089 | B2 | 8/2004 | Inoue et al. |
| 6,789,877 | B2 | 9/2004 | Murakami et al. |

(Continued)

FOREIGN PATENT DOCUMENTS

| | | |
|---|---|---|
| EP | 0 440 499 B | 6/1994 |

(Continued)

*Primary Examiner*—Justin Seo
(74) *Attorney, Agent, or Firm*—Fitzpatrick, Cella, Harper & Scinto

(57) ABSTRACT

A liquid ejection head according to the present invention includes a plurality of ejection openings arranged in a first direction and a plurality of electro-thermal transducers for ejecting liquid from the ejection openings, the liquid ejection head and a printing medium being subjected to the relative movement, wherein an arrangement pitch of the ejection openings forming an end group located in the respective opposite end section along the first direction is longer than an arrangement pitch of the ejection openings forming a central group located in the central section along the first direction. According to the present invention, it is possible to eliminate white streaks which may generate in a solid printing.

15 Claims, 13 Drawing Sheets

U.S. PATENT DOCUMENTS

| | | | |
|---|---|---|---|
| 6,830,309 | B2 | 12/2004 | Murakami |
| 6,848,769 | B2 | 2/2005 | Murakami |
| 2002/0196309 | A1 | 12/2002 | Murakami et al. |

FOREIGN PATENT DOCUMENTS

| | | | | |
|---|---|---|---|---|
| EP | 0 707 965 | A | | 4/1996 |
| EP | 1 072 416 | A | | 1/2001 |
| EP | 1072416 | A1 | * | 1/2001 |
| EP | 1 238 805 | A | | 9/2002 |
| GB | 2 353 499 | | | 2/2001 |
| GB | 2353499 | A | * | 2/2001 |
| JP | 54-56847 | | | 5/1979 |
| JP | 59-123670 | | | 7/1984 |
| JP | 59-138461 | | | 8/1984 |
| JP | 60-71260 | | | 4/1985 |
| JP | 4-10940 | | | 1/1992 |
| JP | 4-10941 | | | 1/1992 |
| JP | 4-10942 | | | 1/1992 |

* cited by examiner

LIQUID EJECTION HEAD AND IMAGE-FORMING APPARATUS USING THE SAME

This is a continuation application of application Ser. No. 10/231,300, filed on Aug. 30, 2002 now abandoned.

This application is based on Patent Application No. 2001-264733 filed Aug. 31, 2001 in Japan, the content of which is incorporated hereinto by reference.

BACKGROUND OF THE INVENTION

1. Field of the Invention

The present invention relates to a liquid ejection head having openings for ejecting liquid and an image-forming device using the same.

In this Specification, a word "print" refers to not only forming a significant information, such as characters and figures, but also forming images, designs or patterns on a printing medium and processing such as etching and so forth in the printing medium, whether the information is significant or insignificant or whether it is visible so as to be perceived by humans. The term "printing medium" includes not only paper used in common printing apparatus, but also sheet materials such as cloths, plastic films, metal sheets, glass plates, ceramic sheets, wood panels and leathers or three-dimensional materials such as spheres, round pipes and so forth which can receive the ink. The word "ink" should be interpreted in its wide sense as with the word "print", refers to liquid that is applied to the printing medium for forming images, designs or patterns, processing such as etching in the printing medium or processing such as coagulating or insolubilizing a colorant in the ink and includes any liquids used for printing.

2. Description of the Related Art

Recently, demand for the high gradation color printing has risen as an internet or a digital camera becomes popular, and an ink jet printers having a higher performance have been developed therewith. The following methods (1) to (3) are known for obtaining a high precision, high gradation and high quality printed image:

(1) An arrangement pitch of openings for ejecting ink is minimized to facilitate the resolution.

(2) A plurality of print heads, each ejecting (at least two kinds of) a specific color ink containing a coloring material of different ratios; i.e., different color concentrations, are prepared and a deep ink and a light ink are selectively printed one over the other if necessary, so that the gradation is improved.

(3) By varying a size or an amount of an ink droplet ejected from the opening, the gradation is improved.

Since the above-mentioned method (3) is relatively difficult to be done in a so-called bubble-jet type printer in which a thermal energy is used for generating a bubble in the ink, a blowing pressure of which is used as an energy for ejecting ink from the opening of the print head, it is thought that the methods (1) and (2) are particularly effective for the bubble-jet type printer.

To realize the method (2), however, two or more print heads are necessary for a specific color ink to result in a high cost. Accordingly, for the bubble-jet type printer, it is most preferable and convenient to adopt a method in which the arrangement pitch of the ejection openings is reduced as in the method (1) and a size of an individual ink droplet ejected from the respective ejection opening is minimized (for example, to 10 picoliter or less) so that the resolution is improved. This is because the production cost hardly rises in this method.

A type for communicating a bubble to an atmosphere via the ejection opening when the small ink droplet is ejected from the ejection opening, which bubble is growing with the heating of ink due to the film boiling is disclosed, for example, in Japanese Patent Application Laid-open Nos. 4-10940 (1992), 4-10941 (1992) and 4-10942 (1992). To differentiate such a type from the conventional bubble-jet type in which the ink droplet is ejected without communicating the bubble growing due to the film boiling with the atmosphere, the former may be called as a bubble-through type.

In the print head of the conventional bubble-jet type in which the ink droplet is ejected without communicating the bubble growing due to the film boiling with the atmosphere, it is necessary to reduce a cross-sectional area of an ink passage communicating with the ejection opening as a size of the ink droplet ejected from the ejection opening becomes smaller. Thereby, an inconvenience may occur in that an ejection speed of the ink droplet is decelerated because of the lowering of ejection efficiency. If the ejection speed of the ink droplet decelerates, the ejecting direction becomes unstable. In addition, the ink is gradually viscous as a moisture is vaporized while the print head is inoperative to cause the ink-ejection to be further unstable, resulting in a premature ejection failure or others. As a result, the reliability may be lowered.

In this respect, the bubble-through type print head in which a bubble communicates with the atmosphere is suitable for ejecting an ink droplet, since a size of the ink droplet could be decided solely by a geometric configuration of the ejection opening, In addition, the bubble-through type print head is advantageous in that it is hardly affected by a temperature or others and an ejection rate of the ink droplet is very stable in comparison with the conventional bubble-jet type print head. Accordingly, it is possible to relatively easily obtain a high precision, high gradation and high quality printed image.

To obtain the high precision, high gradation and high quality printed image, preferably, an extremely small amount of ink droplet is ejected from an individual ejection opening during the printing operation. In this case, it is necessary to eject ink droplets from the ejection opening at a short period for the purpose of obtaining a high printing speed. Further, it is necessary to make a carriage carrying the print head thereon to scan at a high speed relative to a printing medium in synchronism with a drive frequency of the print head. On such a point of view, it could be said that the bubble-through type is particularly suitable for the ink jet printer.

A state of the ejection of ink droplet is depicted in FIG. 11, when a so-called "solid" printing is carried out on a printing medium, in which ink droplets are continuously ejected from all the ejection openings while subjecting the print head of such an ink jet type to the scanning movement at a high speed together with the carriage along the printing medium. The direction of the scanning movement of the print head 1 is vertical to a paper surface of FIG. 11, and the non-illustrated ejection openings are arranged leftward and rightward in the drawing. When the image data is "solid", all of the ejection energy generating elements (not shown) corresponding to the respective ejection openings are driven at a high driving frequency. Therefore, viscous air around the ink droplet 3 ejected from the ejection opening toward the printing medium 2 is also entrained therewith. As a result, a surface area 4 of the print head 1 in which the ejection openings of the print head open is more decompressed than the periphery of the print head 1. Particularly, it has been found that the ink droplets 3 ejected from the ejection openings located at opposite ends of the opening arrangement are sucked toward a center along the arrangement, whereby the ink droplet is not directed to a predetermined position on the printing medium 2. It is apparent from the above-mentioned fact that a plurality of ink droplets ejected from the ejection openings disposed in the end section are drawn to a central section.

In addition, as apparent from a graph of FIG. 12 illustrating the relationship between a total number of the ejection openings actually used and an amount of positional deflection of the ink droplet ejected from the ejection opening located at the arrangement end relative to the printing medium, a phenomenon in which the ejecting direction of the ink droplet 3 is deflected by the influence of the above-mentioned air stream becomes significant generally in proportional to the total number of the ejection openings actually used.

Such an inconvenience is particularly significant in the bubble-through type ink jet printer having a small arrangement pitch of the ejection openings and capable of ejecting a small amount of ink droplet as little as 10 picoliter or less at a short period by one drive operation.

The relationship between an amount of ink droplets and an amount of end-deviation (half a width of the white streak 7) is illustrated in FIG. 13 when the arrangement pitch of the ejection openings is 21.2 μm (corresponding to 1200 dpi). A reason why such a phenomenon appears is that while a ratio of a surface area (a projected area) of the ink droplet relative to a weight of the ink droplet increases as a size of the ink droplet becomes smaller, the movement of the ink droplet is more largely influenced by an air stream.

To avoid this inconvenience, it is also possible to restrict the deflection of ejection trace of the ink droplet ejected from the ejection opening located at the respective opposite arrangement end by enlarging a size of the ink droplet; i.e., by increasing an inertia mass of the ink droplet, ejected from the ejection opening of the respective opposite arrangement end. The enlargement of the ink droplet size, however, causes the obstruction to the formation of a high precision and high gradation image. Further, the permeation of ink droplet into the printing medium is retarded, and the printed image is liable to deteriorate with the swell of the printing medium. Or, it is also possible to mitigate the above-mentioned inconvenience by suppressing the drive frequency for the ejection energy generating elements to a lower level. When the drive frequency for the ejection energy generating elements is set to a lower level, however, the printing speed becomes too slow to satisfy the user's need for obtaining a high speed printing.

SUMMARY OF THE INVENTION

An object of the present invention is to provide, even in an image-forming apparatus capable of ejecting liquid droplets at a high frequency while scanning transverse to the feeding direction of a printing medium, a liquid ejection head adapted to restrict the deviation of the liquid droplets ejected even from ejection openings disposed in the respective opposite end section along the arrangement direction to prevent white streaks from generating in a solid printing and an image-forming apparatus using such an ejection head.

A first aspect of the present invention is a liquid ejection head comprising a plurality of ejection openings arranged in a first direction and a plurality of ejection energy generating elements for ejecting liquid from the ejection openings, the liquid ejection head and a printing medium being subjected to the relative movement, wherein an arrangement pitch of the ejection openings forming an end group located in the respective opposite end section along the first direction is longer than an arrangement pitch of the ejection openings forming a central group located in the central section along the first direction.

According to a first aspect of a liquid ejection head of the present invention, it is possible to adjust a position of the liquid droplet finally reached by the liquid droplet to a predetermined one on the printing medium, whereby a high-precision, multi-gradation and high-quality printed image free from white streaks is obtainable even if the solid printing is carried out. Particularly, when the arrangement pitch of the ejection openings forming an end group is longer from 0.1 to 10 μm than that of the ejection openings forming a central group, the effect of the present invention is more assuredly obtainable. If the difference is less than 0.1 μm, the effect resulted from the widening along the arrangement pitch is hardly obtainable, and also the positional accuracy is not ensured during the production process. Contrarily, if exceeding 10 μm, a distance between the adjacent ejection openings is excessively large to generate white streaks when the solid printing is carried out.

In the liquid ejection head according to the first aspect of the present invention, a diameter of the ejection opening forming the end group may be larger than that of the ejection opening forming the central group. Particularly, when the diameter of the ejection opening forming the end group is twice or less that of the ejection opening forming the central group, it is possible to prevent the white streaks from generating even if the solid printing is carried out by using a print head from which a liquid droplet does not so accurately reach the predetermined position on the printing medium. If exceeding twice, a concentration of the liquid droplet becomes excessively high to generate the irregularity in concentration as well as black streaks when a solid image is formed. In such a manner, it is effective to cause the difference in an arrangement pitch between the ejection openings in the end group and those in the central group to correspond to the difference in a diameter of the dot formed on the printing medium by the liquid droplet ejected from the ejection opening between the end group and the central group. It is also effective to further provide a plurality of liquid passages communicating the liquid to the ejection openings, and to design a width of the liquid passage communicated to the ejection openings forming the end group to be wider than that of the liquid passage communicated to the ejection opening forming the central group. Particularly, when the width of the liquid passage communicated with the ejection opening forming the end group is designed to be twice a width of the liquid passage communicated with the ejection opening forming the central group or less, it is unnecessary to lower the drive frequency applied to the corresponding ejection energy generating source even if an amount of the liquid droplet ejected from the ejection opening forming the end group increases, whereby the high speed driving can be maintained. If exceeding twice, a width of the liquid passage communicated with the ejection opening forming the central group becomes extremely small to lower the ejection frequency in the central group, whereby the printing speed is reduced.

A second aspect of the present invention is a liquid ejection head comprising a plurality of ejection openings arranged in a first direction and a plurality of ejection energy generating elements for ejecting liquid from the ejection openings, the liquid ejection head and a printing medium being subjected to the relative movement, wherein an arrangement pitch of the ejection openings forming an end group located in the respective opposite end section along the first direction and an arrangement pitch of a central group located in the central section along the first direction are equal to each other, and a pitch of the ejection openings forming an intermediate group located between the end group and the central group is longer than the pitch of the ejection openings forming the end group and the central group. Particularly, when the arrangement pitch of the ejection openings forming an intermediate group is increased to be longer from 0.1 to 10 μm than that if the ejection openings forming the end and central groups, the effect of the present invention is further assuredly obtainable. If the difference is less than 0.1 μm, the effect resulted from the widening along the arrangement pitch is hardly obtainable, and also the positional accuracy is not ensured during the production process. Contrarily, if exceeding 10 μm, a distance between the adjacent ejection openings is excessively large to generate white streaks when the solid printing is carried out.

In the liquid ejection head according to the first and second aspects of the present invention, the arrangement pitch of the plurality of ejection openings is preferably 42.3 μm or less. If exceeding 42.3 μm, the effect of the negative pressure atmosphere due to the liquid droplet ejected from the adjacent ejection head is not so significant, whereby the effect of the present invention is hardly obtainable.

An amount of liquid ejected from the individual ejection opening at one time is preferably 10 picoliter or less. Since an inertia mass of the liquid droplet becomes larger if exceeding 10 picoliter, an amount of end-deviation shown in FIG. 13 becomes smaller, whereby the effect of the present invention is hardly obtainable.

The ejection energy generating element may be disposed opposite to the ejection opening.

The ejection energy generating element may include an electro-thermal transducer for causing a film-boiling in the liquid to eject the liquid from the ejection opening.

The first direction may be a feeding direction of the printing medium, the liquid ejection head may be subjected to a scanning movement along a second direction transverse to the first direction.

A third aspect of the present invention is an image-forming apparatus comprising means for mounting a liquid ejection head of the first or second aspect of the present invention and means for feeding a printing medium, wherein an image is formed on the printing medium by the liquid ejected from the ejection openings of the liquid ejection head.

In the image-forming apparatus according to the third aspect of the present invention, the mounting means may have a carriage movable for the scanning movement in the direction transverse to the feeding direction of the printing medium. In this case, the liquid ejection head or the head cartridge is detachably mounted to the carriage via the attachment/detachment means.

The liquid ejection head forms an image by a plurality of scanning movements in the same area of the printing medium.

The liquid is ink and/or a treatment liquid for controlling the printing property of the ink relative to the printing medium.

The ejection openings forming the end group are ready for ejecting the liquid upon the image-formation on the printing medium.

The above and other objects, effects, features and advantages of the present invention will be more apparent from the following description of the preferred embodiments of the present invention with reference to the attached drawings.

DETAILED DESCRIPTION OF PREFERRED EMBODIMENTS

One embodiment in which an image-forming apparatus according to the present invention is applied to an ink jet printer will be described in detail below with reference to FIGS. 1 to 10. The present invention, however, should not be limited to such embodiments but includes the combinations thereof or other technologies contained in the concept of the present invention defined by the scope of claim for the patent.

Figure 1:
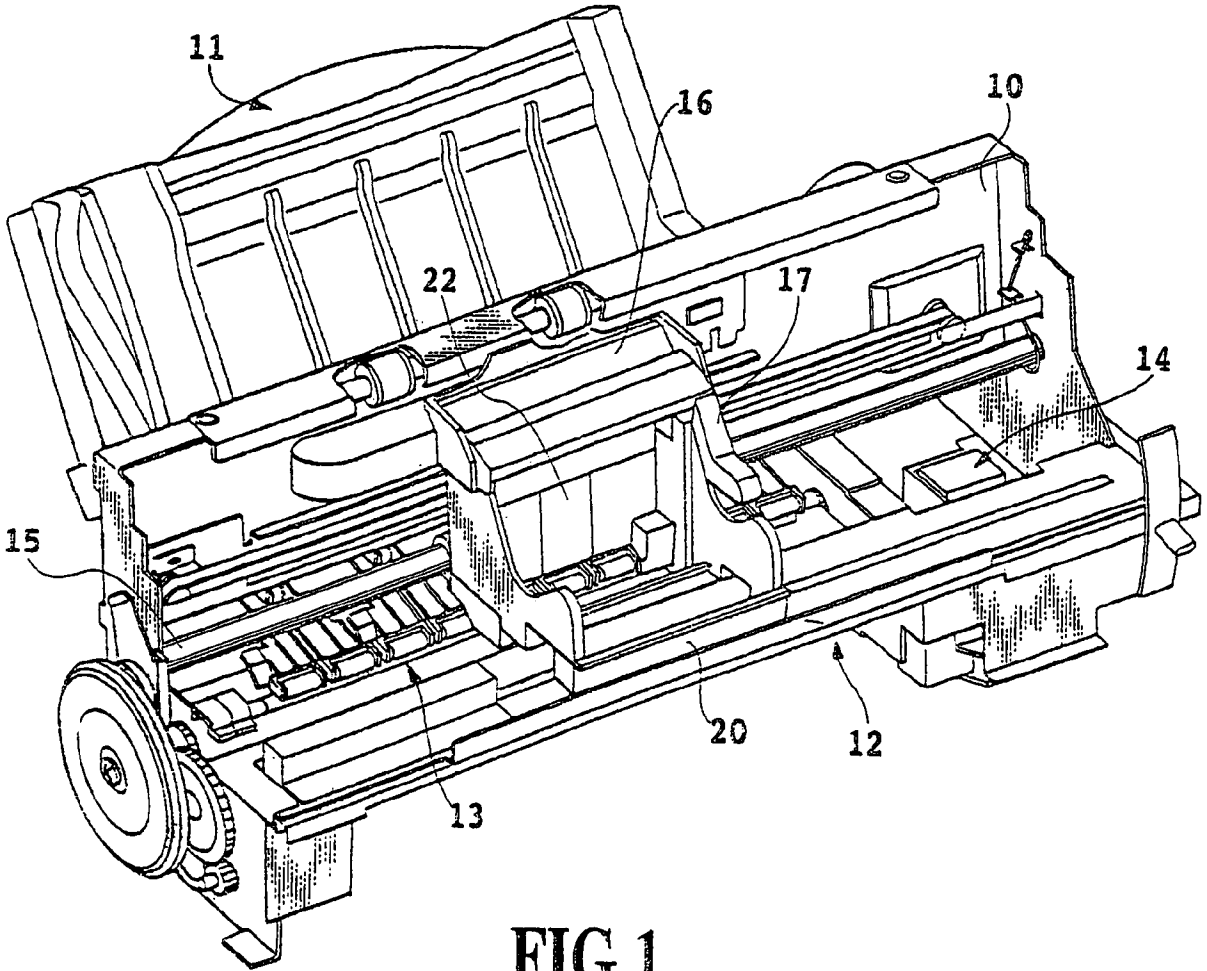
FIG. 1 is a perspective view illustrating a schematic structure of one embodiment of an image-forming apparatus according to the present invention applied to an ink jet printer.
Figure 2:
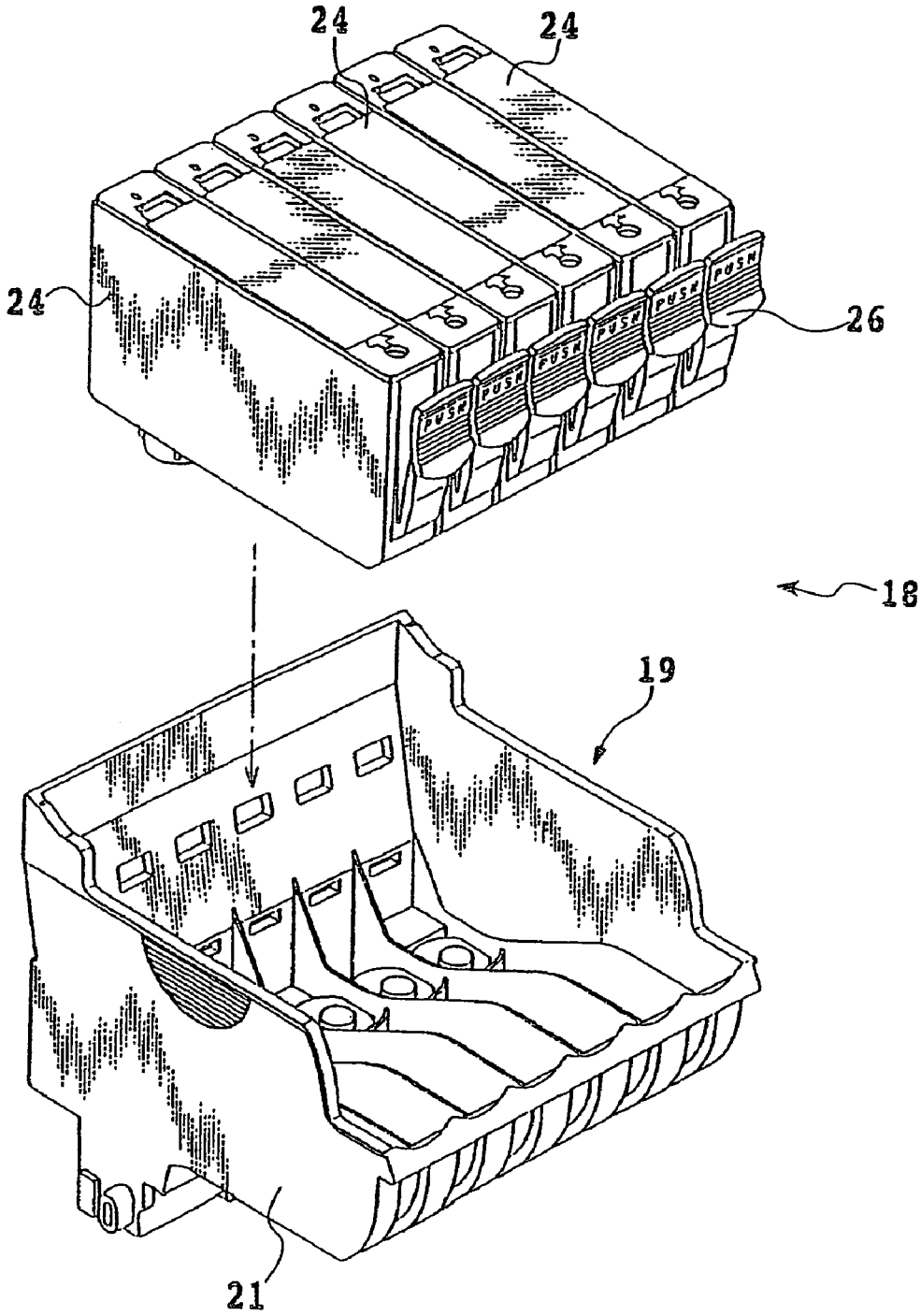
FIG. 2 is an exploded perspective view of an appearance of a head cartridge according to the present invention applied to the ink jet printer shown in FIG. 1.
Figure 3:
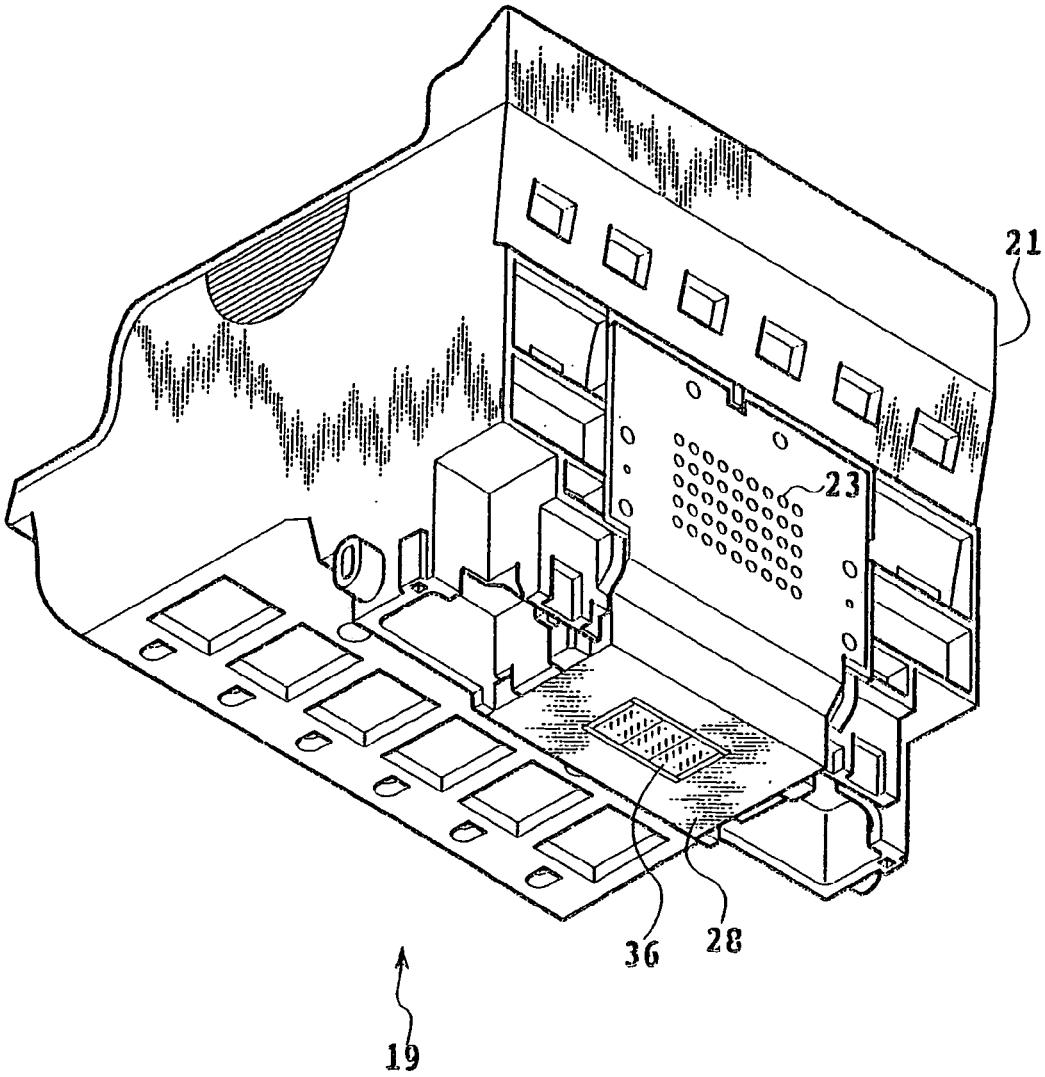
FIG. 3 is a perspective view of the print head in the head cartridge shown in FIG. 2.

An appearance of a mechanism of an ink jet printer according to this embodiment is shown in FIG. 1; an appearance of the head cartridge used in this ink jet printer is shown in FIG. 2 in an exploded manner; and an appearance of a print head thereof is shown in FIG. 3. A chassis 10 of the ink jet printer of this embodiment consists of a plurality of pressed sheet metals having a predetermined rigidity to form a skeleton of the ink jet printer. In the chassis 10, there are incorporated a medium supplying part 11 for automatically feeding a printing medium not shown into the interior of the ink jet printer, a medium feeding part 13 for guiding the printing medium fed one by one from the medium supplying part 11 to a desired printing position and introducing the same from the printing position into a medium discharging part 12, a printing part for carrying out the predetermined printing operation on the printing medium fed to the printing position, and a head recovery part 14 for carrying out the recovery process on the printing part.

The printing part includes a carriage 16 held on a carriage shaft 15 to be movable along the latter, and a head cartridge 18 detachably mounted onto the carriage 16 via a head set lever 17.

The carriage 16 mounting the head cartridge 18 includes a carriage cover 20 for positioning a print head 19 of the head cartridge 18 at a predetermined mounting position on the carriage 16, and the above-mentioned head set lever 17 engageable with a tank holder 21 of the print head 19 to press and locate the print head 19 at the predetermined mounting position. The head set lever 17 used as attachment/detachment means of the present invention is provided in an upper portion of the carriage 16 to be rotatable in relation to a head set lever shaft (not shown). A head set plate (not shown) is provided at a position engaged with the print head 19 while being biased with a spring. The print head 19 is mounted to the carriage 16 while being pressed by the spring force.

One end of a contact flexible print cable (not shown, hereinafter referred to as contact FPC) is connected to another engaging part of the carriage 16 with the print head 19. A contact part (not shown) formed at the end of the contact FPC 22 is electrically connected to a contact part 23 which is provided in an external signal input terminal in the print head 19 to enable input/output of various kinds of information for the printing operation or a power supply to the print head 19.

There is an elastic member such as rubber (not shown) between the contact part of the contact FPC 22 and the carriage 16. By the elasticity of the elastic member and the pressure of the head set plate, the contact of the contact part of the contact FPC 22 with the contact part 23 of the print head 19 is ensured. The other end of the contact FPC 22 is connected to a carriage base (not shown) mounted on a back side of the carriage 16.

The head cartridge 18 of this embodiment has ink tanks 24 storing ink and the above-mentioned print head 19 for ejecting ink supplied from the ink tanks 24 through ejection openings 25 (see FIG. 4) of the print head 19 in accordance with the print information. The print head 19 of this embodiment employs a so-called cartridge type in which it is mounted to the carriage 16 in a detachable manner.

Figure 4:
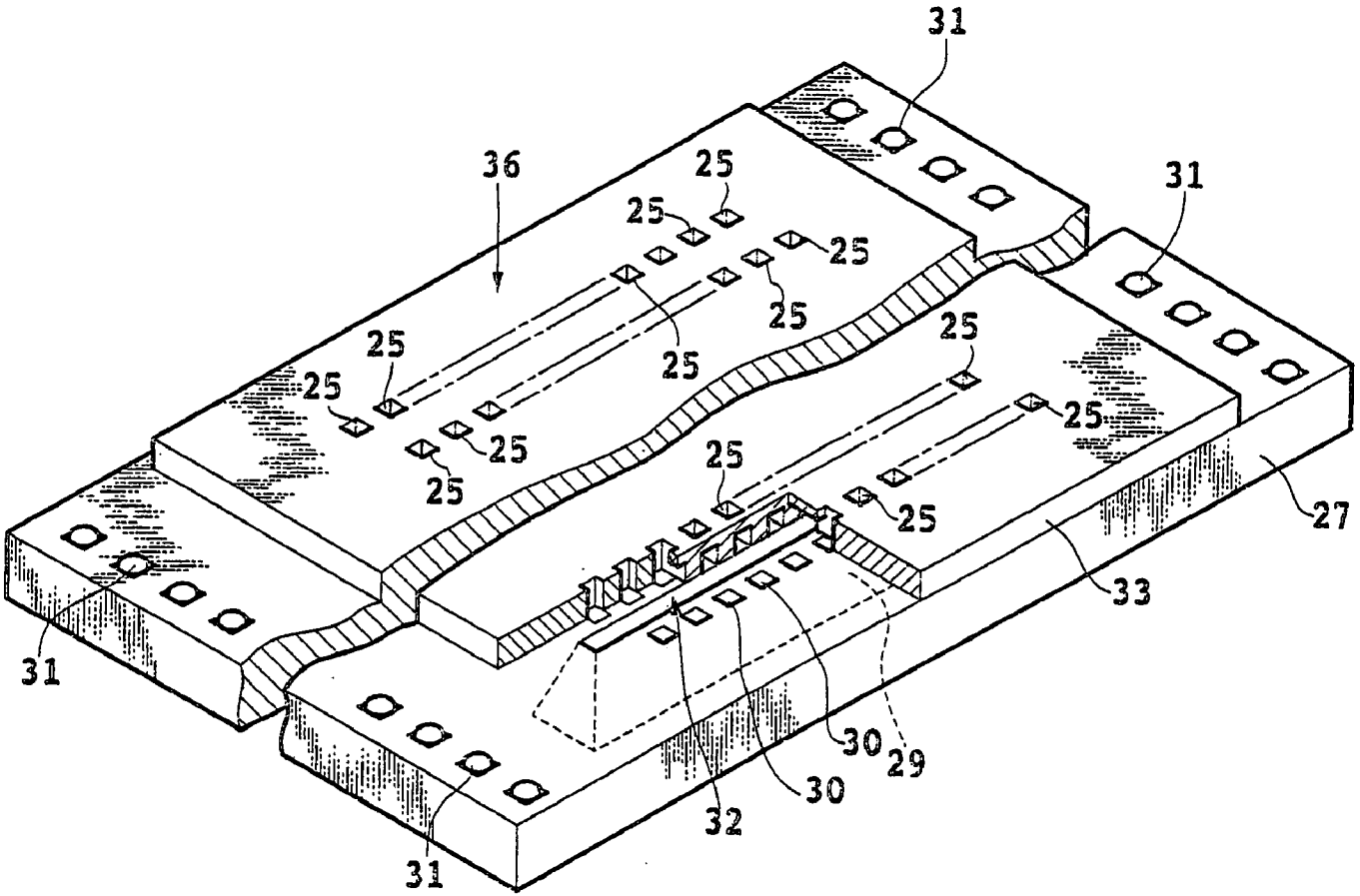
FIG. 4 is a broken perspective view illustrating a schematic structure of a main part of the print head shown in FIG. 3.
Figure 5:
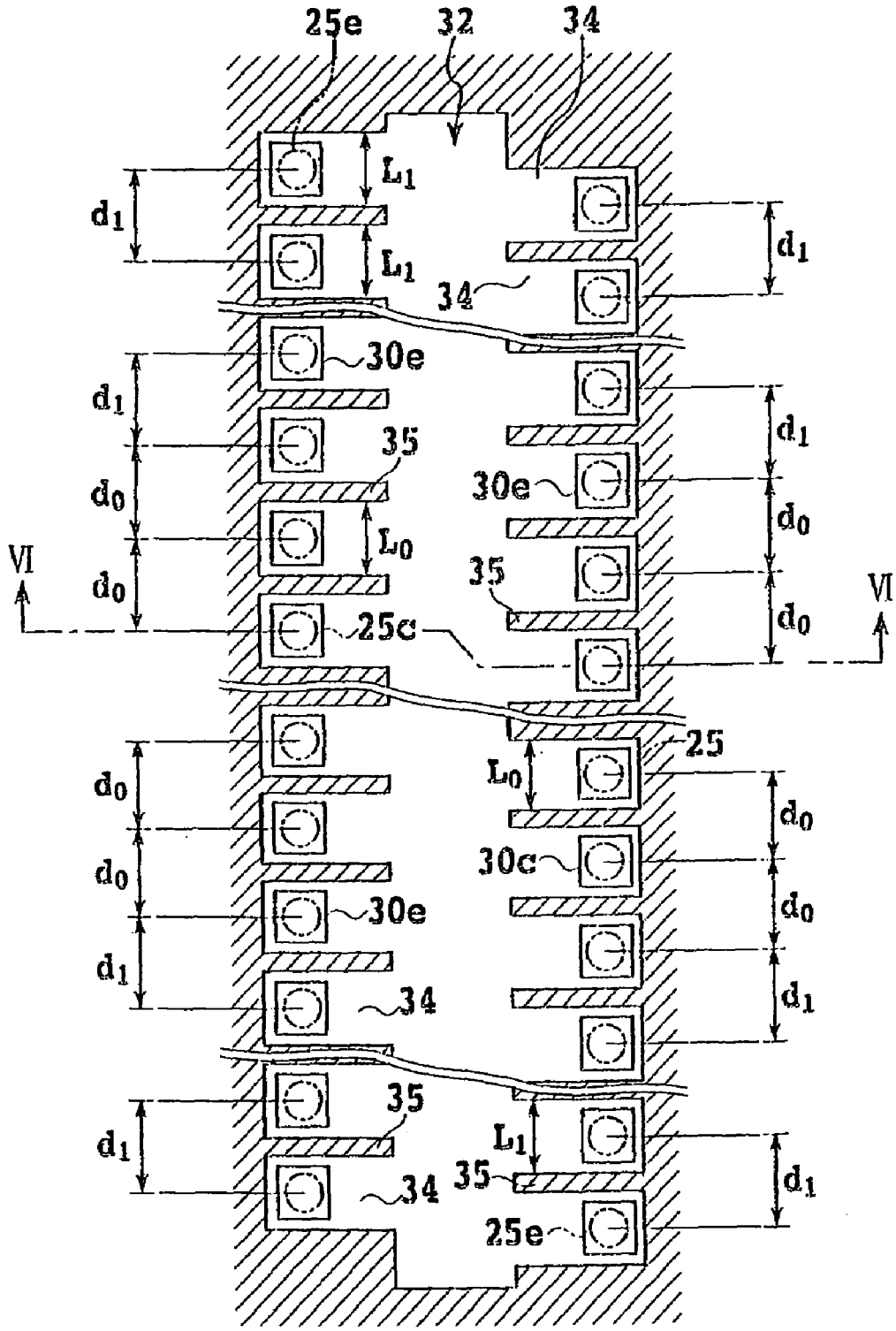
FIG. 5 is a broken plan view illustrating the arrangement of ejection openings and electro-thermal transducers in the print head shown in FIG. 4.
Figure 6:
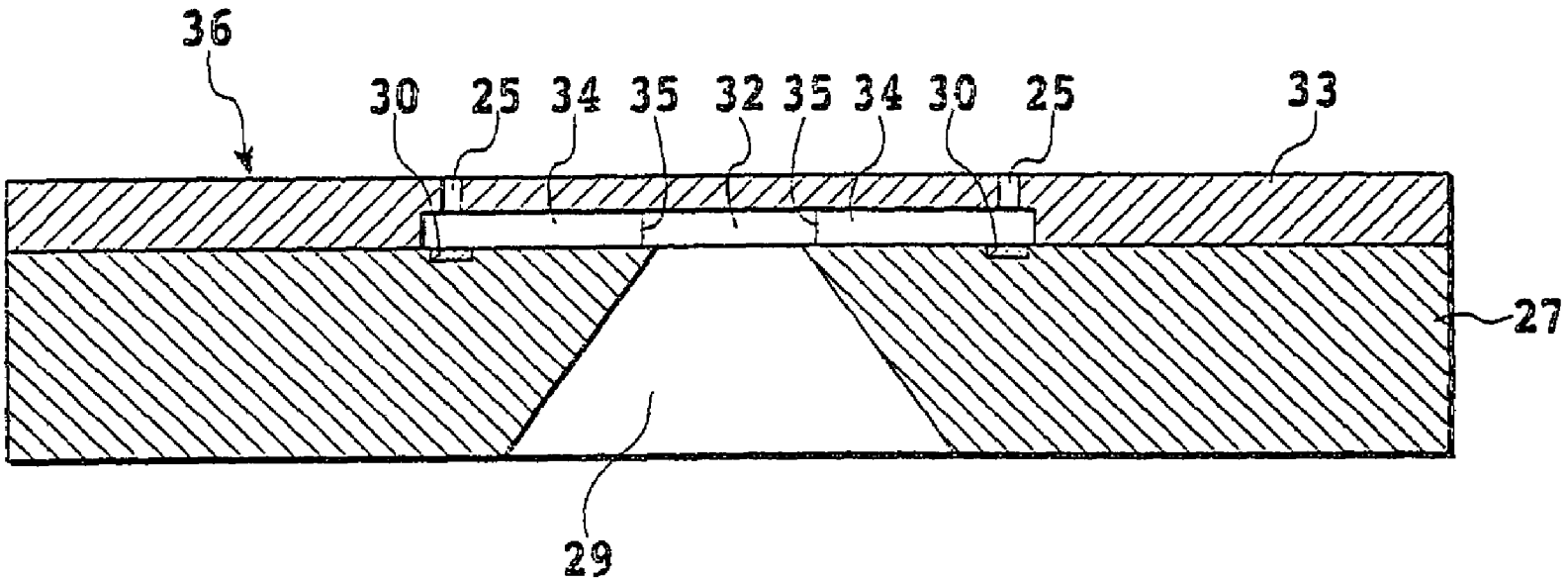
FIG. 6 is a broken sectional view taken along a line VI-VI in FIG. 5.

Since a high-quality color print of a photographic gradation is obtainable according to this embodiment, independent six ink tanks 24 of color ink, for example, of black, pale cyan, pale magenta, cyan and magenta are usable. In the respective ink tank 24, an elastically deformable detachment lever 26 is provided to be engageable with the head cartridge 18. By operating this detachment lever 26, the ink tank 24 is detachable from the print head 19 as shown in FIG. 3. Thus, the detachment lever 26 functions as part of the attachment/detachment means of the present invention. The print head 19 includes a print element substrate 27, an electric wiring substrate 28 described later, the tank holder 21 described before or others. FIG. 4 illustrates a main part of the print head 19 according to this embodiment in a broken manner; FIG. 5 illustrates the arrangement of the ejection openings 25 thereof; and FIG. 6 illustrates a cross-section thereof taken along a line VI-VI. The print element substrate 27 of this embodiment includes an ejection energy generating section, a common ink chamber 32, ink passages 34, ejection openings 25 or others formed on a silicon substrate of 0.5 to 1 mm thick by using a known deposition technology. An elongate ink supplying opening 29 is formed through the print element substrate 27. On opposite sides of the ink supplying opening 29, a plurality (256 per one side in this embodiment) of electro-thermal transducers 30 are arranged in two rows in the feeding direction of the printing medium, that is, in the longitudinal direction of the ink supplying opening 29, at a predetermined pitch while shifting half a pitch in the longitudinal direction to the other row. A distance between center lines of the two rows of the electro-thermal transducers 30 forming the ejection energy generating section, respectively, is 215 μm. In addition to the electro-thermal transducers 30, in the print element substrate 27, electrode terminals 31 for electrically connecting the electro-thermal transducers 30 to the printer body or electric wires of aluminum or others (not shown) are formed by the deposition technology.

The electric wiring substrate 28 to be connected to the electrode terminals 31 formed on the print element substrate 27 operates to apply electric signals for ejecting ink to the print element substrate 27. This electric wiring substrate 28 has an electric wiring corresponding to the print element substrate 27 and the above-mentioned contact part 23 for receiving electric signals from the printer body. The contact part 23 is positioned and fixed to a back side of the tank holder 21. A drive signal is supplied from a drive IC not shown via this electric wiring substrate 28 to the electro-thermal transducer 30, and simultaneously therewith, a drive power is supplied to the electro-thermal transducer 30.

In the tank holder 21 for holding the ink tanks 24 in a detachable manner, ink passages are formed from the ink tanks 24 to the ink supplying opening 29 in the print element substrate 27.

On the print element substrate 27, an upper plate member 33 having a plurality of ejection openings 25 directly opposed to the electro-thermal transducers 30 via the common ink chamber 32 communicated to the ink supplying opening 29. Between the upper plate member 33 and the print element substrate 27, ink passages 34 communicating with the individual ejection openings 25 and the common ink chamber 32 are formed. A partition wall 35 is formed between the adjacent ink passages 34. The common ink chamber 32, the ink passages 34 and the partition walls 35 are formed in a similar manner as in the ejection openings 25 by a lithographic technology together with the upper plate member 33.

Liquid supplied from the ink supplying opening 29 to the respective ink passages 34 is boiled by the heat generated from the electro-thermal transducer 30 due to the drive signal supplied to the electro-thermal transducer 30 opposed to the corresponding ink passage 34, and ejected from the ejection opening 25 by the pressure of bubbles generated thereby. In such a case, the bubble generated in the common ink chamber 32 communicates with an environmental atmosphere as it grows via the ejection opening 25.

In this embodiment, a group consisting of an outermost ejection opening to an inner tenth ejection openings **25*e* or electro-thermal transducers 30*e* along the arrangement direction in one row is arranged at a pitch $d_1$ of 43.3 μm longer by 1 μm than a pitch corresponding to 600 dpi. A central group of the remaining ejection openings 25*c* or the electro-thermal transducers 30*c* is arranged at a pitch $d_0$ of 42.3 μm (corresponding to 600 dpi). Accordingly, the ejection openings 25*e* in the group of the respective opposite end section along the arrangement direction are arranged to be wider by 20 μm as a whole than when all the ejection openings are arranged at a pitch of 600 dpi. The ejection openings 25 in the other row are shifted by ½ pitch relative to those in the one row while maintaining the above-mentioned rule. Thus, the arrangement pitch of the ejection openings 25 in the two rows is approximately equal to 1200 dpi, in which the total number of the ejection openings 25*e* consisting of the end groups is 40 and the total number of the ejection openings 25*c* consisting of the central groups is 472. According to this embodiment, a distance between these two rows (a distance between center lines of the right and left rows of the ejection openings 25) is set to be 21 μm. The electro-thermal transducers 30 have the same dimensions to each other to define a 24 μm square. The ejection openings 25 also have the same dimensions to each other to define a circle of 18 μm diameter. By a drive pulse applied to individual electro-thermal transducer 30 for carrying out one cycle of the operation, an ink droplet of 4.5 picoliter (pl) is ejected from the respective ejection opening 25**. An ejection speed of the ink droplet is in a range from 10 to 15 m/s.

Shapes of the ejection opening 25 may be a rectangle, a circle or a star in addition to a square as in this embodiment, without any problems.

Figure 12:
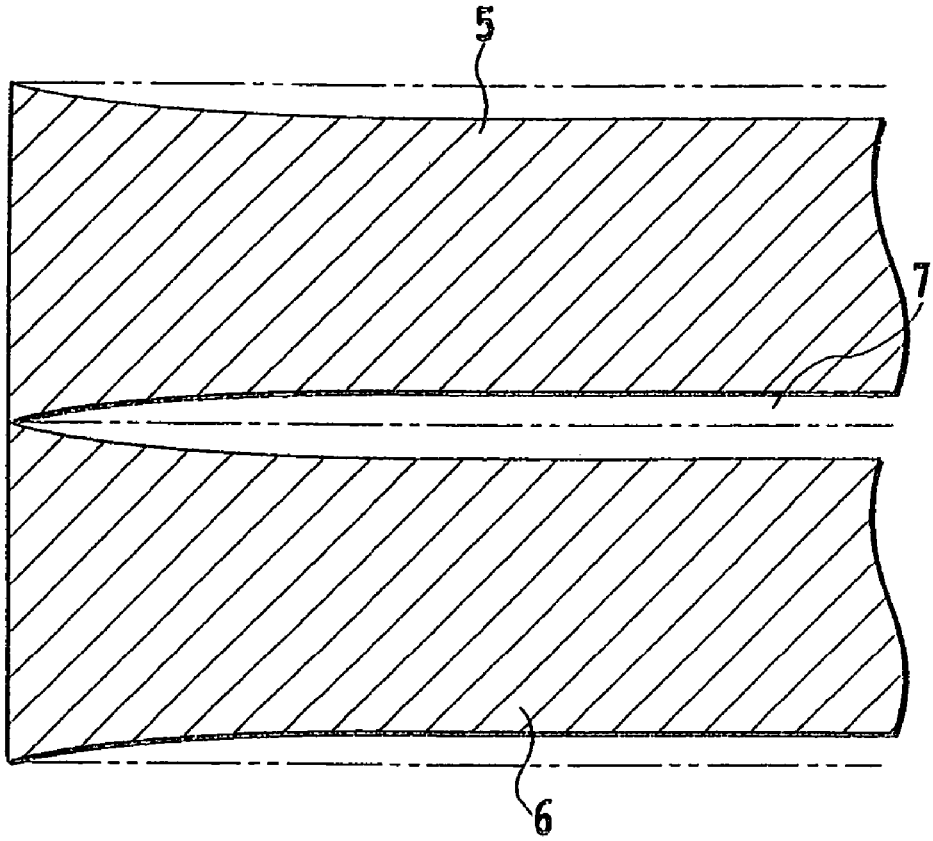
FIG. 12 is a conceptual view illustrating a solid image formed on a printing medium by one passage in the ink ejection manner shown in FIG. 11.
Figure 13:
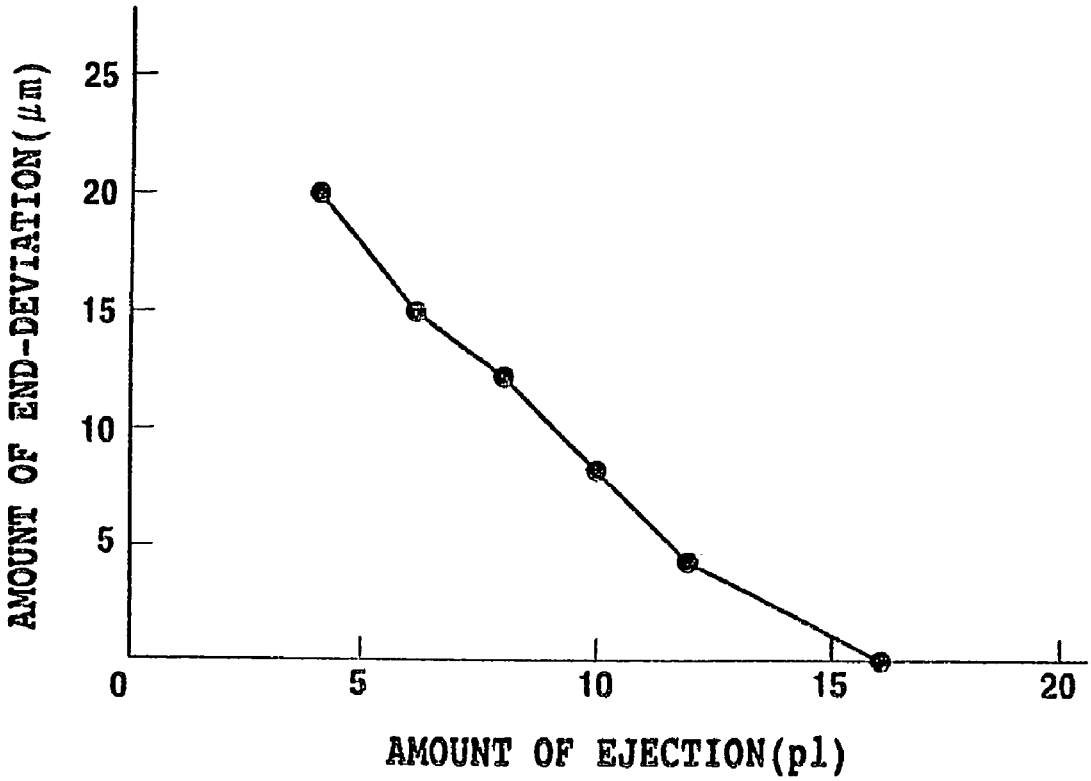
FIG. 13 is a graph representing a relationship between an amount of the ink ejection of the conventional ink jet printer and an amount of the end-deviation.

When ink droplets are continuously ejected from the conventional print head 19 of such an ink jet type while scanning the carriage 16 together therewith along the printing medium at a high speed to carry out a so-called solid printing on the printing medium wherein the above-mentioned pitches $d_0$ and $d_1$ are equal to 42.3 μm (corresponding to 600 dpi), it has been found that a width of white streaks 7 shown in FIG. 12 reaches approximately 70 μm.

Figure 7:
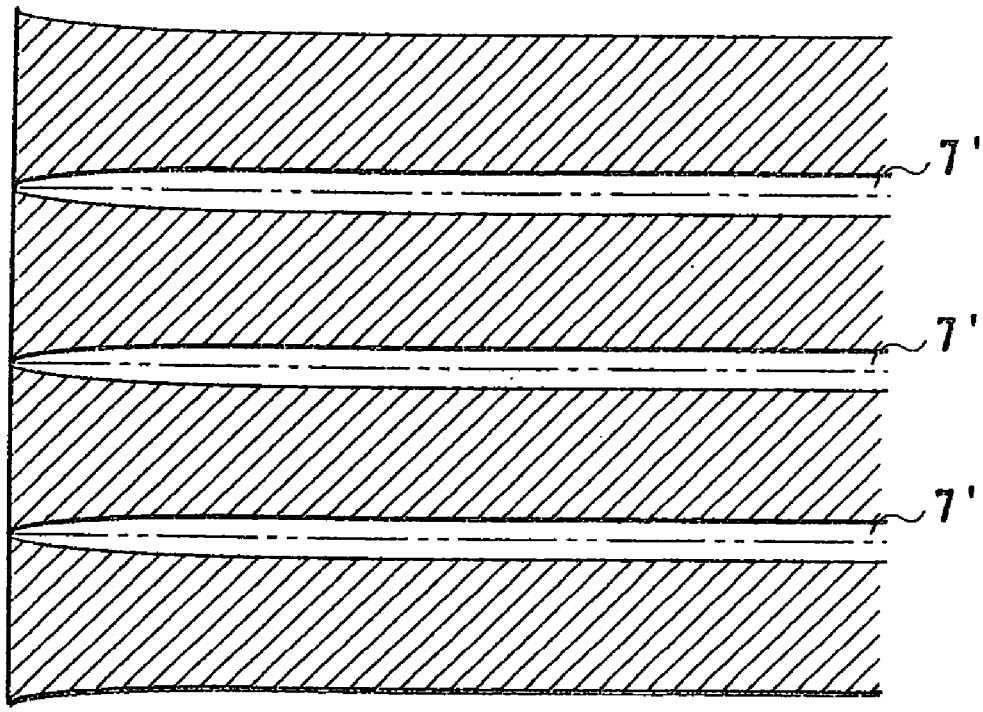
FIG. 7 is a conceptual view illustrating a solid image formed on a printing medium by four passages in the ink ejection manner shown FIG. 12.

When a multi-gradation printing is carried out as in silver halide photography, a multi-scanning system is used. According to this system, an image is formed by feeding the printing medium in a plurality of steps while the print head 19 is subjected to multiple scanning movements in a scanning area corresponding to an arrangement width of the ejection openings 25 of the print head 19, during which the ejection openings 25 are thinned out. In this case, as shown in FIG. 7, a boundary portion between the adjacent scanning paths is slightly light in color, generating color unevenness 7'. However, the color unevenness 7' of such an extent is not practically problematic. According to this embodiment, the printing operation was carried out by four scanning paths while using the printing medium PR-101 (trade name) available from CANON K.K. A width of the unevenness 7' was approximately 40 μm.

According to the study of the present inventors, it has been found that a reason why the width of a white streak; the unevenness 7' becomes smaller in comparison with the aforesaid solid printing is because an end-deviation amount (a half of a width of the white streak, that is, the unevenness 7') becomes smaller when the print duty is low. Thus, when the multi-scanning printing is carried out, it is possible to reduce the shifting amount of the pitch $d_1$ of the ejection openings 25*e* forming the end groups in comparison with the solid printing.

Figure 8:
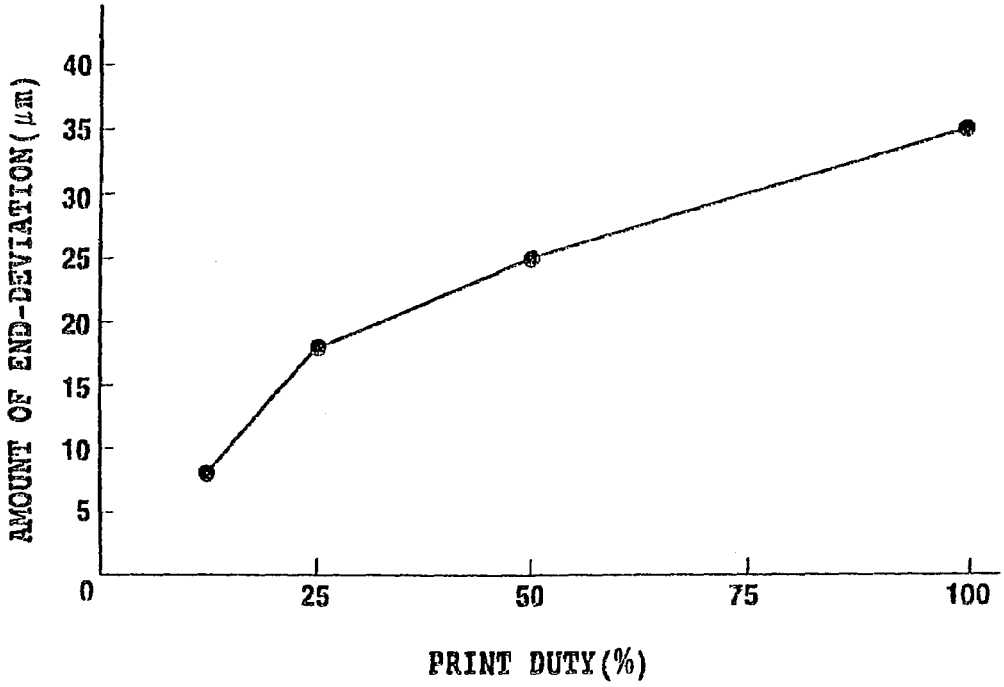
FIG. 8 is a graph representing a relationship between the print duty of the ink jet printer according to the present invention and an amount of the end-deviation.

FIG. 8 is a graph representing the relationship between the print duty and the end-deviation amount. In this graph, The print duty 100% corresponds to the solid printing in which ink droplets are simultaneously ejected from all the ejection openings 25, and therefore the maximum duty in the four scanning printing corresponds to 25%. As apparent from this graph, the pitch of forty ejection openings 25*e* forming the end groups disposed in the respective opposite end section along the arrangement direction is longer by 1 μm than that of the ejection openings 25*c* in the central group. Thus, since a reduced atmosphere is generated in the central section along the arrangement of the ejection openings 25 when the multi-gradation printing is carried out, the ink droplets ejected from the ejection openings 25*e* disposed in the end group along the arrangement direction thereof are drawn to the central section along the arrangement and are finally modified to have an approximately equal pitch as that of the ink droplets ejected from the ejection openings 25*c* arranged in the central section and reaches the printing medium. As a result, white streaks or others generated in every scanning movement of the carriage in the prior art can be avoidable in advance.

When such a multi-gradation printing was carried out, a distance between the printing medium and a plane 36 in which the ejection opening 25 of the print head 19 opens was set at 1.6 mm, and a scanning speed of the carriage 16 was set at 50.8 mm/sec. The frequency for driving the electro-thermal transducer 30 of the print head 19 was 24 kHz.

In the above embodiment, all the ejection openings have the same shape and dimension. It is effective, however, that an opening area of the ejection opening 25*e* forming the respective opposite end group of the arrangement direction may be larger than that of the ejection opening 25*c* forming the central group.

Figure 9:
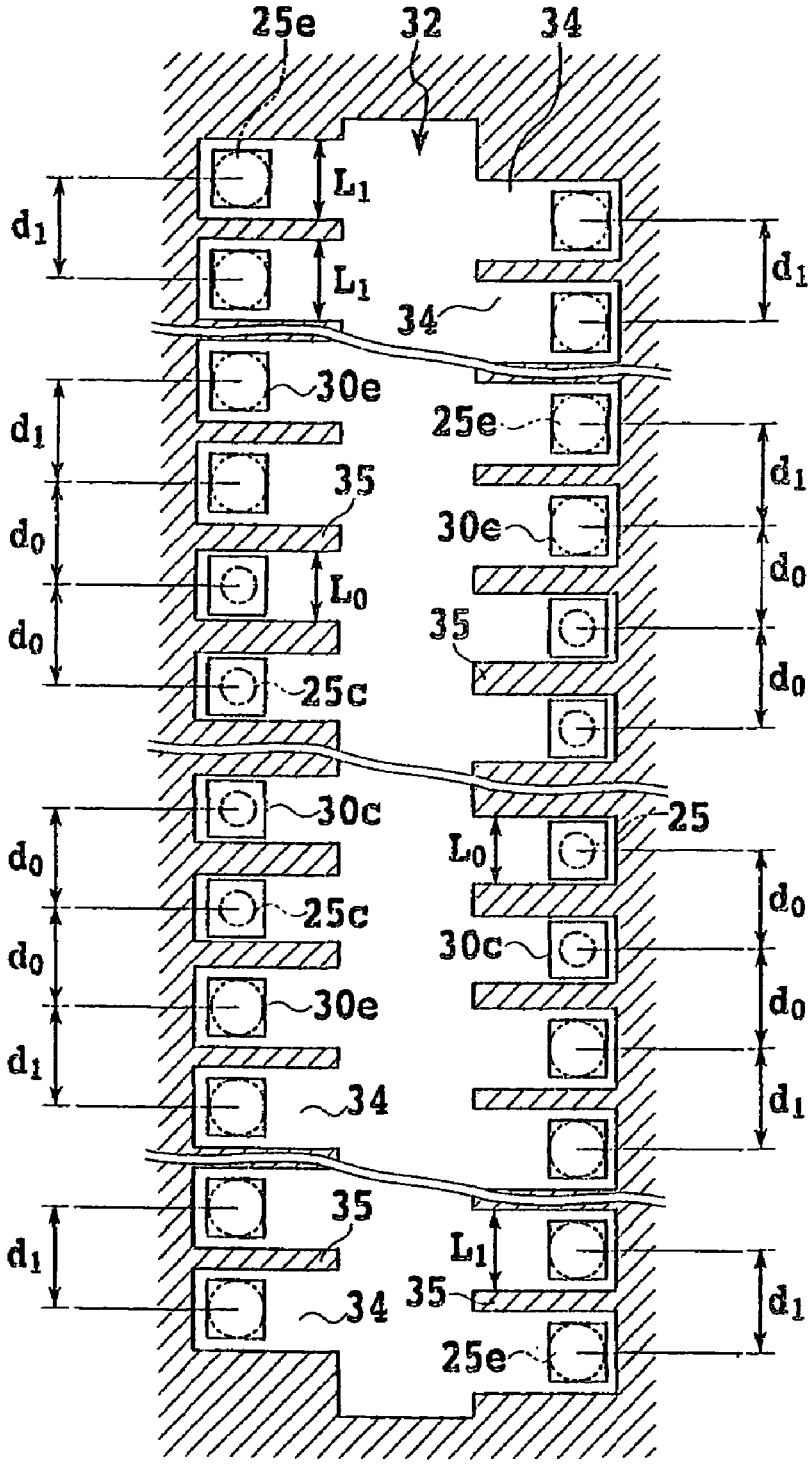
FIG. 9 is a broken plan view illustrating the arrangement of ejection openings and electro-thermal transducers in another embodiment of a print head according to the present invention.

A schematic structure of another embodiment is shown in FIG. 9, in which a liquid ejection head according to the present invention is applied to the above-mentioned print head. In this regard, the same reference numerals are used for designating elements having the same function in those of the preceding embodiment and the explanation thereof will be eliminated for the purpose of avoiding the superfluity. In this embodiment, a diameter of the ejection opening 25*c* in the central group is 18 μm, and that of the ejection opening 25*e* in the respective opposite end group consisting of the outermost one to the inner tenth one is 19 μm. In other words, while there would be no problem in a print head having a favorable performance in that the ink droplet correctly reaches a predetermined position on the printing medium, a problem may arise when an inferior print head 19 is used, in that an ink droplet ejected therefrom does not so accurately hit a predetermined position on the printing medium. To solve such a trouble, the diameter of the ejection opening 25*e* in the end group is larger so that a diameter of a dot formed on the printing medium by the ink droplet ejected therefrom becomes larger to cover up the positional inaccuracy of the dot and prevent the generation of white streaks in the solid printing.

In this regard, when coated paper having a bleeding ratio of 2.2 is used as a printing medium, it is adjusted that an amount of ink droplet ejected from the ejection opening 25*c* in the central group along the arrangement direction thereof is 4.5 pl to form a dot having a diameter of 45 μm on the printing medium, while an amount of ink droplet ejected from the ejection opening 25*e* in the respective opposite end group along the arrangement direction thereof is 5.5 pl to form a dot having a diameter of 48 μm on the printing medium.

When the amount of ink droplet ejected from the ejection opening 25*e* in the respective end group along the arrangement direction thereof increases, there is a possibility in that the response of ink supply to the drive of the electro-thermal transducer 30*e* may be lowered. To avoid the lowering of this response in such a case, a width of the ink passage 34 may be increased, or a thickness of the partition wall 35 between the adjacent ink passages 34 may be reduced. Concretely, a width $L_1$ of the ink passage 34 communicating with the ejection opening 25*e* in the respective opposite end group is designed to be wider than a width $L_0$ of the ink passage 34 communicating with the ejection opening 25*c* in the central group.

In the above embodiment, the arrangement pitch $d_1$ of the ejection openings 25*e* or the electro-thermal transducers 30*e* disposed in the respective opposite end group of the arrangement direction is longer than the arrangement pitch $d_0$ of the ejection openings 25*c* or the electro-thermal transducers 30*c* disposed in the central group of the arrangement direction. However, as is discussed with reference to a further embodiment illustrated in FIG. 10, the same effect is obtainable even if the arrangement pitches of the ejection openings 25*e* and 25*c* disposed in the respective opposite end group and the central group and those of the ejection energy generating elements thereof are equal to each other, provided the arrangement pitch of the ejection openings 25*m* disposed in an intermediate group between the end group and the central group or ejection energy generating elements corresponding thereto is longer than the arrangement pitch of the ejection openings 25*e* and 25*c* in the respective opposite end group and the central group.

Figure 10:
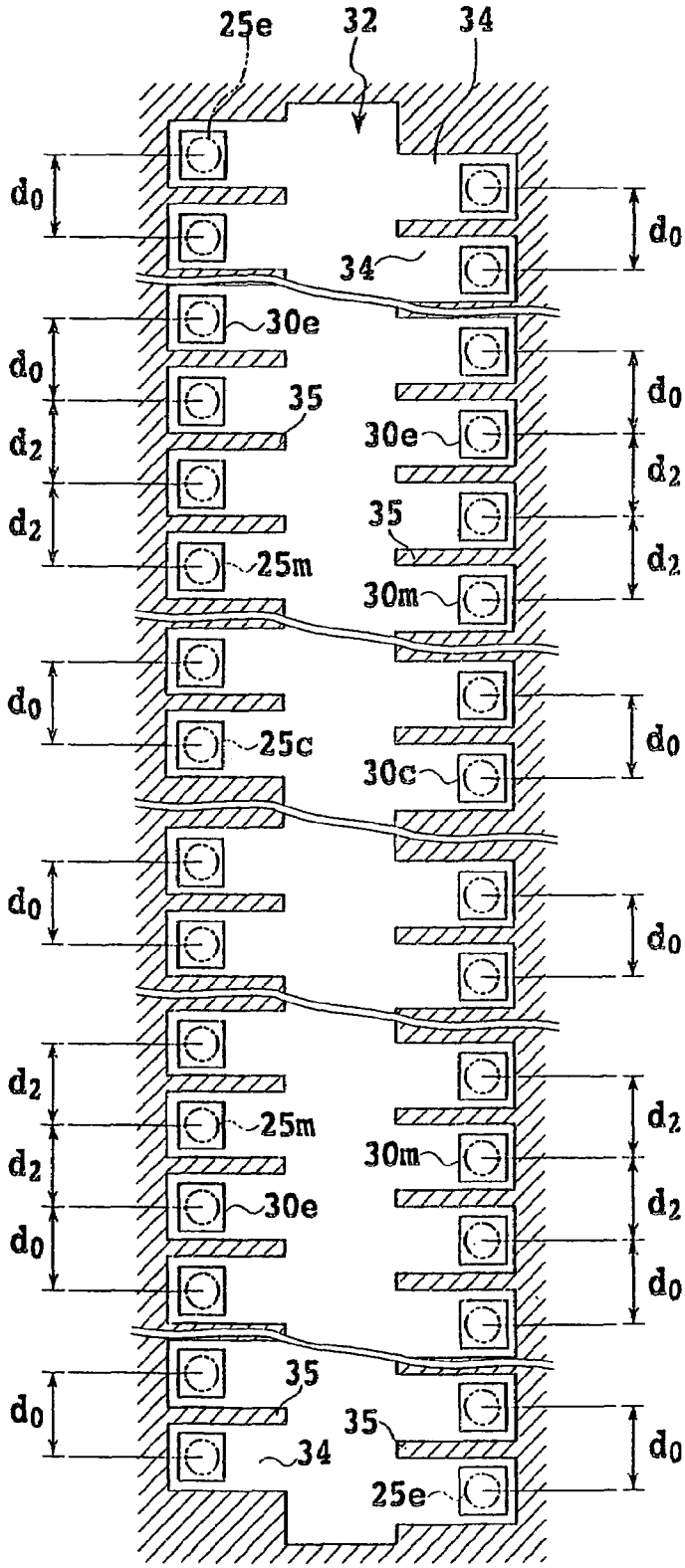
FIG. 10 is a broken plan view illustrating the arrangement of ejection openings and electro-thermal transducers in a further embodiment of a print head according to the present invention.
Figure 11:
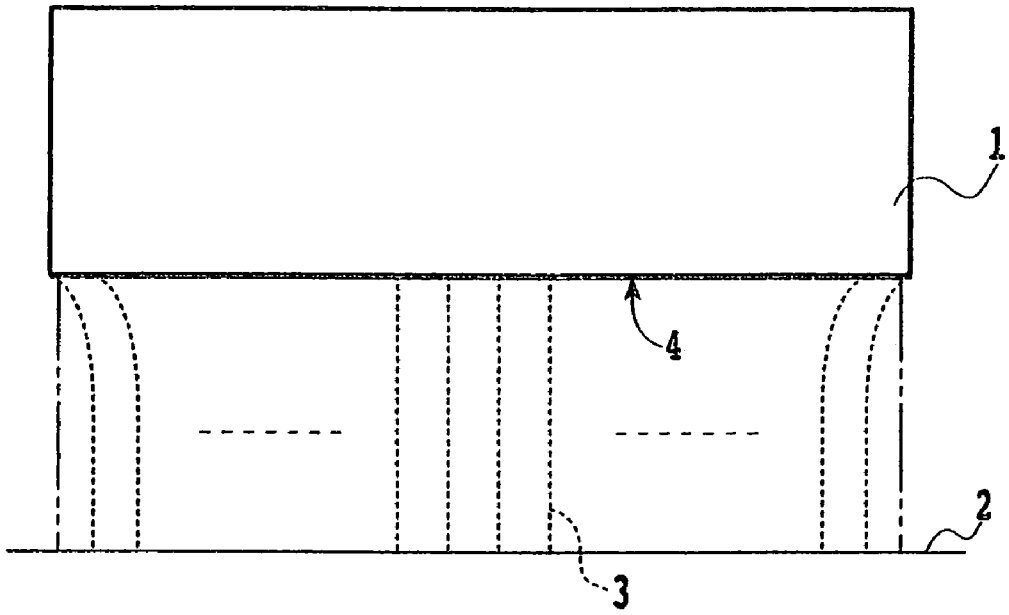
FIG. 11 is a conceptual view schematically illustrating the ejection of ink from the conventional ink jet printer.

FIG. 10 illustrates a schematic structure of a further embodiment according to the present invention in which the liquid ejection head of such a type is applied to the above-mentioned print head. In this regard, the same reference numerals are used for designating elements having the same function in those of the preceding embodiment and the explanation thereof will be eliminated for the purpose of avoiding the superfluity. The ejection openings 25*e* or the electro-thermal transducers 30*e* from the respective opposite end one along the arrangement direction to an inner tenth one are disposed at a pitch $d_0$, that is, 600 dpi (42.3 μm). The ejection openings 25*m* or the electro-thermal transducers 30*m* from the inner tenth one along the arrangement direction to a seventeenth one forming the intermediate group are disposed at a pitch $d_2$ of 45.3 μm which is longer 3 μm than 600 dpi. The ejection openings 25*c* or the electro-thermal transducers 30*c* forming the central group located inner than the former group are all arranged at a pitch $d_0$ (42.3 μm). Accordingly, the ejection openings 25*e* in the respective opposite end group of the arrangement direction are shifted by 21 μm to be wider than a case wherein all the ejection openings 25 are arranged at a pitch corresponding to 600 dpi. The two rows of ejection openings 25 are shifted by half a pitch relative to each other. Accordingly, the arrangement pitch of the two ejection openings 25 becomes approximately 1200 dpi as a whole, which is the same as the preceding embodiment. In this embodiment, a gap between the two rows of the ejection openings (a distance between center lines of the right and left rows of the ejection openings 25) is also 21 μm. Also, all the electro-thermal transducers 30 have the same dimensions to be a 24 μm square. All the ejection openings 25 have the same dimensions to be a circle having a diameter of 18 μm. By the drive pulse for one operation of the individual electro-thermal transducer 30, an ink droplet of 4.5 pl is ejected from the ejection opening 25 corresponding thereto. An ejection speed of the ink droplet is in a range from 10 to 15 m/sec.

68 ejection openings 25*e* and 25*m* in the opposite end groups and the intermediate groups subsequent thereto are shifted to be wider in the arrangement pitch than that of the ejection openings 25*c* forming the central group. Accordingly, even if the solid printing is carried out by using such a print head, ink droplets ejected from the ejection openings 25*e* and 25*m* positioned closer to the respective opposite end are drawn toward the center along the arrangement so that a pitch of dots finally formed on the printing medium by these ink droplets is corrected to be approximately equal to a pitch of the ink droplets ejected from the ejection openings 25 in the central group and reaching the printing medium. As a result, it is possible to prevent defects such as white streaks from generating, which might generate in every scanning movement of the carriage 16 in the prior art.

The present invention achieves distinct effect when applied to the liquid ejecting head, the head cartridge, or the image printing apparatus which has means for generating thermal energy such as electrothermal transducers or laser beam, and which causes changes in ink by the thermal energy so as to eject liquid. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid, and operates as follows: first, one or more driving signals are applied to the electrothermal transducers to cause thermal energy corresponding to printing information; second, the thermal energy induces sudden temperature rise that exceeds the nucleate boiling so as to cause the film boiling on heating portions of the liquid ejecting head; and third, bubbles are grown in the liquid corresponding to the driving signals. By using the growth and collapse of the bubbles, the ink is expelled from at least one of the ejecting ports of the head to form one or more liquid drops. The driving signal in the form of a pulse is preferable because the growth and collapse of the bubbles can be achieved instantaneously and suitably by this form of driving signal. As the driving signal in the form of a pulse, those described in U.S. Pat. Nos. 4,463,359 and 4,345,262 are preferable.

In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a liquid ejecting head, which is incorporated to the present invention: this structure includes heating portions disposed on bent portions in addition to a combination of the ejecting ports, liquid passages and the electrothermal transducers disclosed in the above patents. Moreover, the present invention can be applied to structures disclosed in Japanese Patent Application Laid-open Nos. 59-123670 (1984) and 59-138461 (1984) in order to achieve similar effects. The former discloses a structure in which a slit common to all the electrothermal transducers is used as ejecting ports of the electrothermal transducers, and the latter discloses a structure in which openings for absorbing pressure waves caused by thermal energy are formed corresponding to the ejecting ports. Thus, irrespective of the type of the liquid ejecting head, the present invention can achieve printing positively and effectively.

The present invention can be also applied to a so-called full-line type liquid ejecting head whose length equals the maximum width across a printing medium. Such a liquid ejecting head may consists of a plurality of liquid ejecting heads combined together, or one integrally arranged liquid ejecting head.

In addition, the present invention can be applied to various serial type liquid ejecting heads: a liquid ejecting head fixed to the main assembly of an image printing apparatus; a conveniently replaceable chip type liquid ejecting head which, when loaded on the main assembly of an image printing apparatus, is electrically connected to the main assembly, and is supplied with liquid therefrom; and a cartridge type liquid ejecting head integrally including a liquid reservoir.

It is further preferable to add a recovery system for ejecting liquid from the ejecting head in adequate condition, or a preliminary auxiliary system for a liquid ejecting head as a constituent of the image printing apparatus because they serve to make the effect of the present invention more reliable. Examples of the recovery system are a capping means and a cleaning means for the liquid ejecting head, and a pressure or suction means for the liquid ejecting head. Examples of the preliminary auxiliary system are a preliminary heating means utilizing electrothermal transducers or a combination of other heater elements and the electrothermal transducers, and a means for carrying out preliminary ejection of liquid independently of the ejection for printing. These systems are effective for reliable printing.

The number and type of liquid ejecting heads to be attached on an image printing apparatus can be also detached. For example, only one liquid ejecting head corresponding to a single color ink, or a plurality of liquid ejecting heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing. In this case, the treatment liquid (the printability enhanced liquid) for adjusting the printing state of the ink may also be ejected from each individual heads or a common ejecting head to the printing medium in accordance with a kind of the printing medium or the printing mode.

Furthermore, although the above-described embodiments use liguids, liquids that are liquid when the printing signal is applied can be used: for example, liquids can be employed that solidify at a temperature lower than the room temperature and are softened or liquefied in the room temperature. This is because in the ink jet system, the liquid is generally temperature adjusted in a range of 30° C. to 70° C. so that the viscosity of the liquid is maintained at such a value that the liquid can be ejected reliably. In addition, the present invention can be applied to such apparatus where the liquid is liquefied just before the ejection by the thermal energy as follows so that the liquid is expelled from the ports in the liquid state, and then begins to solidify on hitting the printing medium, thereby preventing the liquid evaporation: the liquid is transformed from solid to liquid state by positively utilizing the thermal energy which would otherwise cause the temperature rise; or the liquid, which is dry when left in air, is liquefied in response to the thermal energy of the printing signal. In such cases, the liquid may be retained in recesses or through holes formed in a porous sheet as liquid or solid substances so that the liquid faces the electrothermal transducers as described in Japanese Patent Application Laid-open Nos. 54-56847 (1979) or 60-71260 (1985). The present invention is most effective when it uses the film boiling phenomenon to expel the liquid.

Furthermore, the image printing apparatus in according to the present invention can be employed not only as an image output terminal of an information processing device such as a computer, but also as an output device of a copying machine combining with a reader or the like, a facsimile apparatus having a transmission and receiving function, or printing press for cloth. A sheet or web paper, a wooden or plastic board, a stone slab, a-plate glass, metal sheet, a three dimensional structure or the like may be used as the printing medium in according to the present invention.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A liquid ejection head comprising a plurality of ejection openings arranged in a first direction and a plurality of ejection energy generating elements for ejecting liquid from the ejection openings, said liquid ejection head and a printing medium being subjected to relative movement, wherein each arrangement pitch of the ejection openings forming both end groups located in respective opposite end sections along the first direction is longer than an arrangement pitch of the ejection openings forming a central group located in a central section along the first direction, respectively, wherein the ejection openings forming the end groups are configured to eject the liquid for forming an image on the printing medium, and wherein ink droplets ejected from the ejection openings forming the end groups are drawn toward the central group to have a droplet pitch approximately equal a droplet pitch of ink droplets ejected from the ejection openings forming the central group.

2. A liquid ejection head as claimed in claim 1, wherein the arrangement pitch of the ejection openings forming at least one of the end groups is longer by 0.1 to 10 μm than that of the ejection openings forming the central group.

3. A liquid ejection head as claimed in claim 1, wherein a diameter of each of the ejection openings forming at least one of the end groups is larger than a diameter of each of the ejection openings forming the central group.

4. A liquid ejection head as claimed in claim 3, wherein a difference between diameters of dots formed by liquid droplets ejected from the ejection openings forming at least one of the end groups and the central group, respectively, on the printing medium corresponds to a difference between the arrangement pitches of the ejection openings forming at least one of the end groups and the central group, respectively.

5. A liquid ejection head as claimed in claim 3, wherein the diameter of each of the ejection openings forming at least one of the end groups is twice or less than twice that of each of the ejection openings forming the central group.

6. A liquid ejection head as claimed in claim 1, wherein the arrangement pitch of the plurality of ejection openings forming at least one of the end groups is 42.3 μm or less and the arrangement pitch of the plurality of ejection openings forming the central group is 42.3 μm or less.

7. A liquid ejection head as claimed in claim 1, wherein an amount of the liquid once ejected from an ejection opening is 10 picoliters or less.

8. A liquid ejection head as claimed in claim 1, wherein the ejection energy generating elements are disposed opposite to the ejection openings.

9. A liquid ejection head as claimed in claim 1, wherein each of the ejection energy generating elements includes an electro-thermal transducer for ejecting the liquid from a corresponding ejection opening by film-boiling of the liquid.

10. A liquid ejection head as claimed in claim 1, wherein the first direction is a feeding direction of the printing medium, and said liquid ejection head is subjected to scanning movement along a second direction transverse to the first direction.

11. An image-forming apparatus comprising mounting means for the liquid ejection head as claimed in claim 1, and means for feeding the printing medium, to form an image on the printing medium with the liquid ejected from the ejection openings of the liquid ejection head.

12. An image-forming apparatus comprising mounting means for the liquid ejection head as claimed in claim 1, and means for feeding the printing medium, to form an image on the printing medium with the liquid ejected from the ejection openings of the liquid ejection head, wherein the mounting means has a carriage movable for scanning movement in a direction transverse to a feeding direction of the printing medium.

13. An image-forming apparatus comprising mounting means for the liquid ejection head as claimed in claim 1, and means for feeding the printing medium, to form an image on the printing medium with the liquid ejected from the ejection openings of the liquid ejection head, wherein the liquid ejection head is detachably mounted to a carriage via attachment/detachment means.

14. An image-forming apparatus comprising mounting means for the liquid ejection head as claimed in claim 1, and means for feeding the printing medium, to form an image on the printing medium with the liquid ejected from the ejection openings of the liquid ejection head, wherein the liquid ejection head forms an image by a plurality of scanning movements in the same area of the printing medium.

15. An image-forming apparatus comprising mounting means for the liquid ejection head as claimed in claim 1, and means for feeding the printing medium, to form an image on the printing medium with the liquid ejected from the ejection openings of the liquid ejection head, wherein the liquid is an ink and/or a treatment liquid for controlling a printing property of the ink relative to the printing medium.

* * * * *